US005718046A

United States Patent [19]

Wang

[11] Patent Number: 5,718,046

[45] Date of Patent: Feb. 17, 1998

[54] METHOD OF MAKING A CERAMIC COATED EXHAUST MANIFOLD AND METHOD

[75] Inventor: Yucong Wang, Saginaw, Mich.

[73] Assignee: General Motors Corporation, Detroit, Mich.

[21] Appl. No.: 570,023

[22] Filed: Dec. 11, 1995

[51] Int. Cl.[6] ..... B23P 15/00

[52] U.S. Cl. ..... 29/890.08; 29/527.3

[58] Field of Search ..... 29/890.08, 527.3; 60/272, 323; 427/235, 376.1, 376.2

[56] References Cited

U.S. PATENT DOCUMENTS

| | | | |
|---|---|---|---|
| 3,936,383 | 2/1976 | Daimon et al. | 252/63 |
| 4,884,400 | 12/1989 | Tanaka et al. | 60/323 |
| 4,930,678 | 6/1990 | Cyb | 228/176 |
| 4,956,319 | 8/1990 | Dwivedi et al. | 29/527.3 |
| 4,972,674 | 11/1990 | Yamada et al. | 60/323 |
| 4,975,314 | 12/1990 | Yano et al. | 428/213 |
| 5,018,661 | 5/1991 | Cyb | 228/176 |
| 5,142,863 | 9/1992 | Ushio et al. | 60/272 |
| 5,188,712 | 2/1993 | Dilmon et al. | 204/98 |
| 5,238,881 | 8/1993 | Norris | 501/20 |
| 5,404,721 | 4/1995 | Hartsock | 60/300 |

FOREIGN PATENT DOCUMENTS

| | | |
|---|---|---|
| EP 0 101 911 | 3/1984 | European Pat. Off. . |
| EP 0 352 246 | 1/1990 | European Pat. Off. . |
| DE3638807 | 5/1988 | Germany . |
| JP61070119 | 4/1986 | Japan . |
| JP62211138 | 9/1987 | Japan . |
| JP0407578A | 3/1992 | Japan . |

OTHER PUBLICATIONS

Patent Abstracts of Japan, vol. 95, no. 008 & JP 07 208160A, 8 August 1995, abstract.

Patent Abstracts of Japan, vol. 010, no. 238, 16 Aug 86 & JP 61 070119 A, 10 Apr 86, abs.

Patent Abstracts of Japan, vol. 011, no. 322, 20 Oct 87 I& JP 62 107084 A, 18 May 87.

Patent Abstracts of Japan, vol 016, no. 434, 10 Sep 92 & JP 04 148017 A, 21 May 92.

European Search Report corres to EP 96 20 3165 & Annex dated 25 March 1997.

*Primary Examiner*—Irene Cuda

*Attorney, Agent, or Firm*—Lawrence B. Plant

[57] ABSTRACT

A cast iron exhaust manifold having an inside surface covered with a ceramic coating comprising, by weight, about 30% to about 70% unfused silica, about 5% to about 30% magnesia, about 5% to about 20% alumina and about 3% to about 10% sodium oxide. The coating will preferably be built up in multiple layers at least one of which is relatively porous and another is relatively dense resulting from vacuum degassing of the slurry used to deposit the coating.

8 Claims, 2 Drawing Sheets

METHOD OF MAKING A CERAMIC COATED EXHAUST MANIFOLD AND METHOD

This invention relates to thermally insulated exhaust manifolds for internal combustion engines, and more particularly to cast iron manifolds having a ceramic insulating coating thereon.

BACKGROUND OF THE INVENTION

It is known to coat or line the inside surface of an exhaust manifold for an internal combustion engine with a ceramic material to insulate the manifold and reduce the amount of heat emitted into a vehicle's engine compartment, and to promote early "light-off" of the vehicle's catalytic converter for more effective treatment of the exhaust gases. Cast-in-place ceramic liners provide good insulation, but are expensive and highly susceptible to cracking due to thermal expansion mismatch with the iron. Many prior art coatings are similarly expensive and crack prone.

SUMMARY OF THE INVENTION

The present invention is a cast iron exhaust manifold, and method of making same, having an improved ceramic coating which is durable, inexpensive, simple to apply, thermally stable, compatible with the thermal expansion of the iron, and provides excellent thermal insulation, thermal shock resistance and corrosion/oxidation resistance. The coating will preferably be applied to the inside surface of the manifold, but may also be applied to the outside surface as well for increased insulation and corrosion protection of the manifold inside and out.

In accordance with the present invention, there is provided an exhaust manifold for an internal combustion engine (e.g., gasoline, diesel, etc.) comprising a cast iron shell having an inside surface covered with a coating comprising, by weight, 30% to 70% unfused silicon oxide ($SiO_2$), 5% to 30% magnesium oxide (MgO), 5% to 20% aluminum oxide ($Al_2O_3$), 3% to 10% sodium oxide ($Na_2O$), and the balance impurities such as titanium oxide ($TiO_2$), calcium oxide (CaO) and chromium oxide ($Cr_2O_3$) in concentrations of about 1% to 5% of each. More specifically, particles of $SiO_2$ and MgO are held together in a binder formed from kaolin, montmorillonite and sodium silicate. The composition is formulated to have (1) a low thermal conductivity, (2) high heat capacity and operating temperature, (3) thermal expansion compatibility with the cast iron shell that hosts the coating, and (4) high temperature thermal stability and durability. The coating will preferably be built up to the desired thickness by the application of several thinner layers one atop the other. More preferably, the outermost surface of the coating (i.e., contacting the exhaust gases) will be relatively dense and comprise only mini pores (i.e., ca. 5–20 microns) left by the evaporation of water, while at least one underlayer is relatively more porous (i.e., about 5% to about 15% by volume) containing macro pores (i.e., ca. 50–200 microns) for increased thermal resistivity. Most preferably, the first layer which is applied directly against the cast iron will also be relatively dense for enhanced adhesion to the iron casting and protection of the interface between the coating and the casting from the exhaust gases. Hence, a most preferred coating will include a dense first layer contiguous the iron casting, at least one porous layer atop the first layer, and finally a dense outermost layer exposed directly to the exhaust gases.

The coating is applied from a slurry of $SiO_2$ and MgO ceramic particles, and kaolin and montmorillonite mineral particles suspended in an aqueous solution of sodium silicate wherein the molar ratio of silica-to-sodium oxide in the sodium silicate is preferably about 2.5 to about 3.8. Each layer of slurry is dried before the next layer is applied. After the last layer has dried, the entire coating is heated sufficiently to cure the sodium silicate and react it with the surfaces of the ceramic particles. Vacuum degassing of the slurry prior to coating produces a high density layer. Coating with an undegassed slurry results in a macro porous highly insulating layer (i.e., about 5% to about 15% by volume). In accordance with the most preferred embodiment of the invention, a dense layer is first applied with a vacuum degassed slurry directly against the casting, and dried. Thereafter one or more macro porous layers is/are applied with an undegassed slurry and dried. Finally, a relatively dense outermost layer is coated with a degassed slurry and dried. The entire coating is then heated to cure the sodium silicate and bond it to the ceramic particles. The resulting preferred coating comprises a porous layer sandwiched between two dense layers.

DETAILED DESCRIPTION OF A SPECIFIC EMBODIMENT OF THE INVENTION

The present invention will be better understood when considered in the light of the following detailed description thereof which is given hereafter in conjunction with the several Figures in which.

Figure 1:
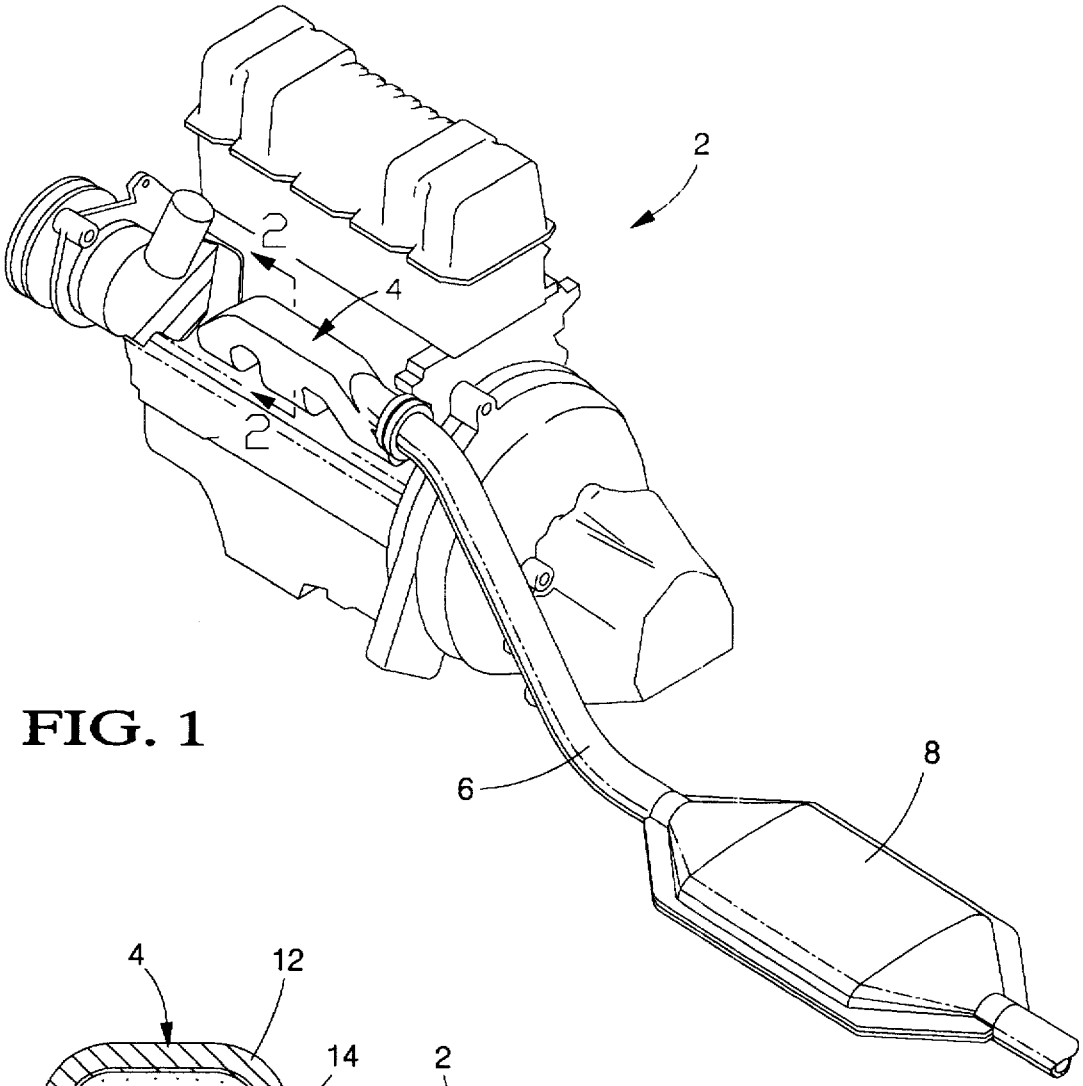
FIG. 1 is a perspective view of an internal combustion engine and exhaust system therefor.
Figure 2:
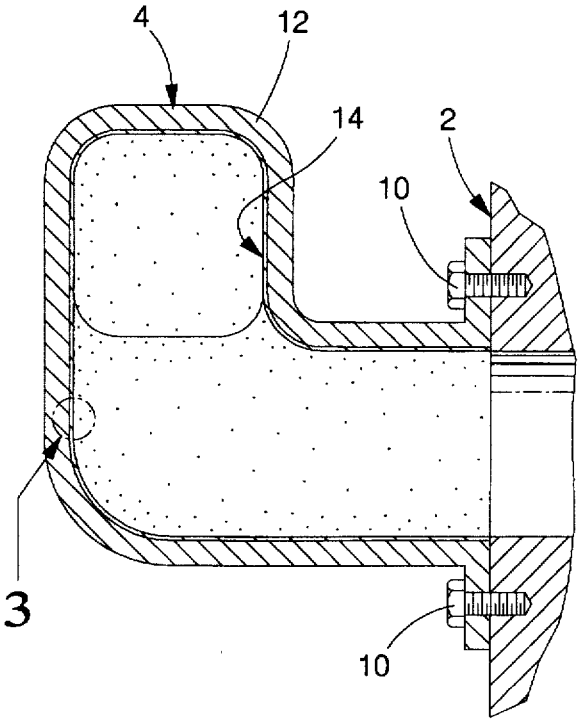
FIG. 2 is a sectioned view in the direction 2—2 of FIG. 1.
Figure 3:
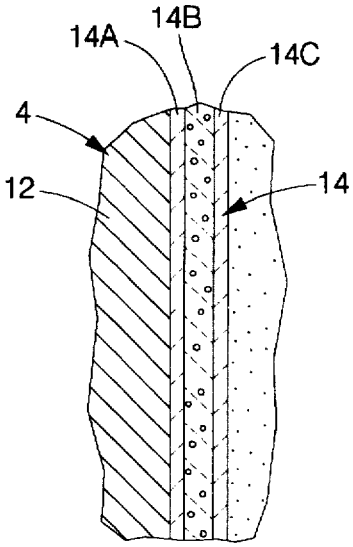
FIG. 3 is a magnified view of the region indicated (3) in FIG. 2.

FIGS. 1–3 show an internal combustion engine 2 having an exhaust manifold 4 coupled to an exhaust pipe 6 which, in turn, is coupled to a catalytic converter 8. The exhaust manifold 4 is secured to the engine 2 via bolts 10 and comprises a cast iron (e.g., malleable, nodular, etc.) shell 12 having its inside surface covered with a ceramic coating 14. The coating 14 will comprise at least one layer of a ceramic material, to be described hereafter and will preferably have a thickness between about 1 mm and about 4 mm, and most preferably between about 2.5 to about 3.0 mm. Thinner coatings do not provide as much thermal insulation as thick ones yet, thicker coatings are more susceptible to cracking and more expensive to make.

The coating 14 will preferably comprise a plurality of thin layers **14*a*, 14*b*, 14*c* built up one atop the other to make up the desired overall thickness of the coating 14. Each layer will preferably have a thickness of about 0.8 mm to about 1.0 mm. Most preferably, the coating 14 will comprise a porous underlayer 14*b* covered by a relatively dense outermost layer 14*c*. The porous layer 14*b* provides enhanced thermal resistance while the relatively dense layer 14*c* protects the porous layer 14*b* from invasion by the exhaust gases. In a most preferred embodiment, the inside surface of the shell 12 will also first be coated with a dense layer 14*a* of the ceramic for improved adhesion to the shell 12 and protection of the interface 16 therebetween from the corrosive effects of the exhaust gases. In this embodiment, the porous layer 14*b* will then be sandwiched between the dense layers 14*a* and 14*c***.

Figure 4:
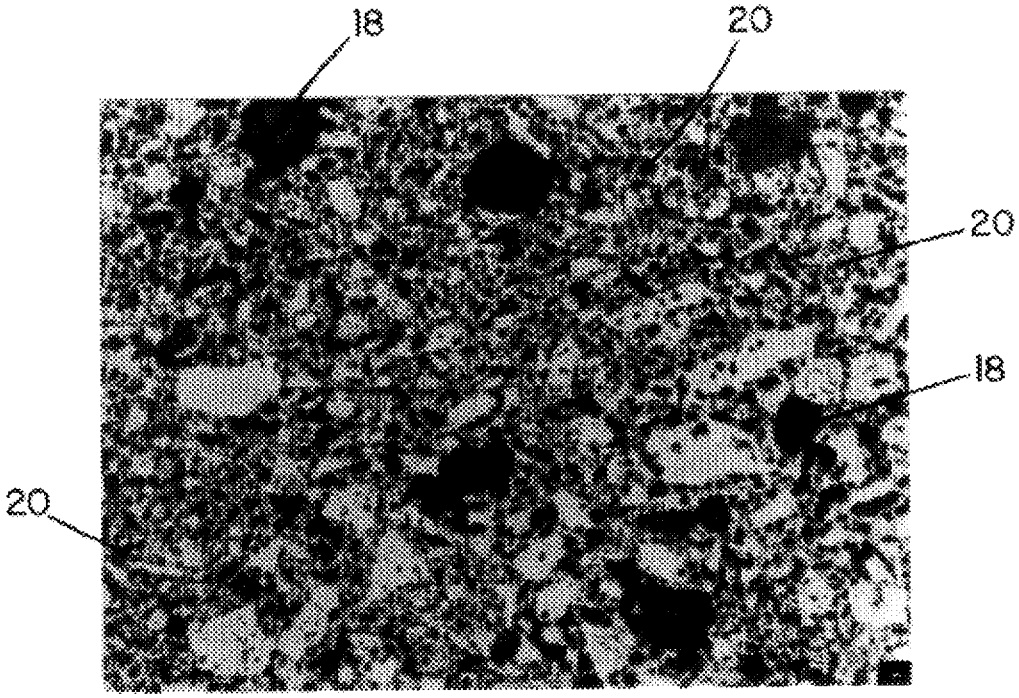
FIG. 4 is an optical photomicrograph (100x) of the porous middle layer of a three layer coating.
Figure 5:
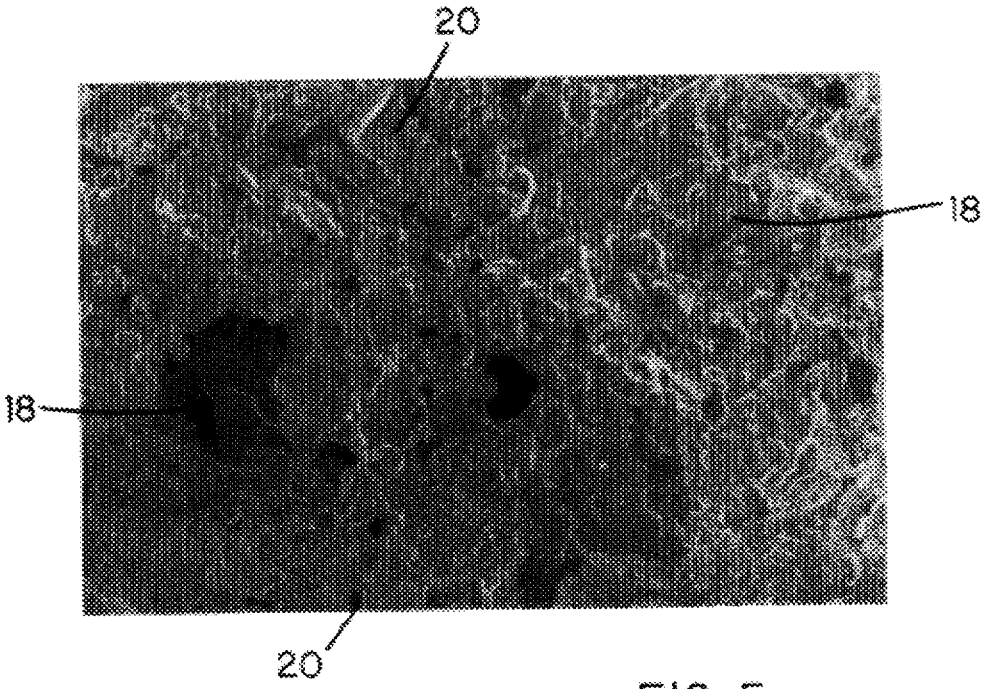
FIG. 5 is an SEM photomicrograph (500x) of the same layer as shown in FIG. 4.

One of the advantages of the present invention is that the ceramic coating 14 is chemically the same throughout, i.e., from one layer to the next, and is deposited in exactly the same manner (i.e., except for degassing) from one layer to the next hence simplifying the process and reducing the overall cost of applying the coating. However, having different proportions of the ingredients could be used to more closely tailor the properties of the coating (e.g., match the thermal expansion to that of the iron shell by providing a thermal expansion gradient from one layer to the next). The macroporosity of any or all of the different layers 14*a*, 14*b*, 14*c* that make up the coating 14 can readily be changed by subjecting the slurry used to deposit the layers to a vacuum. Subjecting the slurry to a vacuum of about 1 Tort for a few minutes is usually sufficient to remove almost all of the gases from the slurry which are introduced therein by mixing, and results in the formation of a relatively dense layer. Lesser vacuums will remove lesser volumes of gas and result in lower macroporous layers. If no vacuum is used, the mixing gases remain entrained within the slurry, and result in the formation of macro pores (i.e., ca. 50–200 microns) 18 (see FIGS. 4 and 5) throughout coatings made therefrom which provide a better insulative barrier than the denser coatings. Macroporosities of about 5% to about 15% have been achieved with undegassed slurries depending on the precise composition of the slurry. Mini pores (i.e., ca. 5–20 microns) 20 resulting from the evaporation of water pervade both the dense and macroporous layers.

Chemically, the coating of the present invention comprises a mixture of the ceramic particles in the size range of about 2 microns to about 50 microns (i.e., about 30 microns average) held together in a binder formed by sodium silicate, kaolin and montmorillonite. Kaolin is a white clay comprising principally the mineral kaolinite (i.e., $Al_2Si_2O_5(OH)_4$) which is a hydrous silicate of aluminum. Montmorillonite is a soft clay mineral $RMgAl_5Si_2O_{30}(OH)_6.H_2O$, where R is a hydrous aluminum silicate with considerable capacity for exchanging part of the aluminum for magnesium, alkalis and other bases. The ceramic particles comprise about 70% to about %85 of the finished coating with the balance being the binder that holds the ceramic particles together.

The particle mix used to form the slurry used to coat the manifold comprises, on a weight basis, about 55%–65% silica, about 25%–35% magnesia ceramic particles, and about 2%–8% each of kaolin and montmorillonite mineral particles. The kaolin and montmorillonite contain small amounts of calcium oxide, titanium oxide and chromium oxide which come out as impurities in the finished coating. In formulating the composition of the coating, particular attention is paid to matching the coefficient of thermal expansion of the coating as closely as possible to the shell iron (e.g., coefficient of thermal expansion of ductile iron is $13\times10^{-6}/°K$) in order to prevent cracking and/or separation from the shell. A most preferred particle mix comprises by weight about 30% magnesia, about 60% unfused silica, about 5% kaolin and about 5% montmorillonite.

The mix of ceramic and mineral particles is suspended in an aqueous solution of sodium silicate. The sodium silicate preferably has a silica-to-sodium oxide ratio between 2.5 and 3.8 and comprises about 20%–40% of the aqueous solution. When the $SiO_2$/NaO ratio falls below about 2 adhesive bonds are weaker and very water sensitive. When the $SiO_2$/NaO ratio is above about 4, crazing or microcracking of the coating occurs. A suitable commercially available mixer is effective for mixing the particles into the solution. In laboratory tests ½ gallon batches were mixed with a KitchenAid K5SS mixer. The particles comprise about 40% to about 48% by weight of the slurry and the balance sodium silicate solution. A slurry of the most preferred particle mix and silicate solution yields a finished coating comprising about 25% magnesia, about 66% unfused silica, about 7% aluminum oxide, about 6% sodium oxide, and the balance impurities derived from the mineral particles.

To coat the inside surface of the shell 12, all but one of the openings in the manifold 4 are plugged or sealed closed, and the slurry poured into the shell 12 through the one unplugged opening. The shell is then vibrated or shaken to insure that the entire inner surface is wetted by the slurry. The slurry is then dumped out leaving a layer of wet slurry clinging to the inner surface. The layer of slurry will typically have a thickness of about 0.8 mm to about 1.0 mm depending on the viscosity of the slurry which typically varies between about 30 poises to about 100 poises. Low viscosity slurries produce thinner layers which can crack due to excessive shrinkage occurring during drying. If the slurry is too viscous the layer formed is too thick and can readily crack due to high internal stresses induced into the layer during drying. The first layer is deposited, and dried at a temperature of less than about 70° C. (preferably at about room temperature) for 1 to 5 hours. Thereafter, the process (i.e., coat and dry) is repeated to lay down a series of successive layers one atop the other to build up to the desired overall thickness of the coating (preferably about 2.5 mm to about 3 mm). Laying down the coating in several thin layers makes drying simpler with less chance of any water remaining in the coating. The heating rate should be low enough to insure that the vaporization rate of the water is lower than the vapor release rate from the coating to avoid formation of gas bubbles in the coating. In the event it is desired to coat both the inside and the outside surfaces of the casting, the casting may simply be dipped into the slurry and withdrawn to coat both surfaces.

The porosity of each layer is readily adjusted by subjecting the slurry used to form a particular layer to a vacuum prior to coating the manifold. In order to deposit a dense layer, the slurry is subjected to a vacuum of about 1 Torr for about 1 to about 5 minutes at room temperature. Most preferably, the first/innermost (i.e., contiguous the casting) and the last/outermost (i.e., exposed to the exhaust gas) layers will be dense and made with vacuum degassed slurries, and intermediate layer(s) will be porous made from slurry(s) which has/have not been degassed. Alternating (e.g., dense-porous-dense-porous-dense) layers may also be formed and are both strong and highly insulative. After the last (i.e., outermost) layer has dried, the manifold is fired in order to vaporize and release any remaining water (including crystallized water), and to promote chemical reactions at the interfaces between the ceramic particles and the sodium silicate that chemically bond the particles together. In this regard, the polymeric silicate species in the silicate solution form chain units which connect the ceramic particles together. The firing process may take several hours, and will preferably be effected in a stepwise fashion wherein the coated manifold is progressively heated to higher and higher temperatures. A preferred firing schedule includes: (1) heating at a rate of about 5° C./min. up to 85° C. and holding for 1 hour; (2) thereafter, further heating at 5° C./min. up to 120° C. and holding for 2 hours; and finally (3) thereafter heating at 5° C./min. up to 250° C. and holding for 2 hours.

Chemically, the final coating will comprise, by weight, about 30%–70% unfused silica, about 5%–30% magnesia, about 5%–20% aluminum oxide, about 3%–10% sodium oxide, and the balance titania, calcium oxide, and chromium oxide $Cr_2O_3$, as impurities derived from the kaolin and montmorillonite mineral starting materials. The final composition of the coating is reported in terms of the oxides of the key ingredients in keeping with common practice in the ceramic arts where more complex and controversial molecular forms such as aluminum silicates and magnesium silicates are actually present but differences of opinion exist as to their precise molecular structure.

Unfused silica is used as a structural component which has chemical compatibility with the silicate solution and other ceramic components. The silica prevents shrinkage and crazing of the coating. When the silica concentration falls below about 30% shrinkage and crazing will be exacerbated. When the silica concentration exceeds about 70% the coefficient of thermal expansion of the coating will be too low for use with cast iron shell.

Magnesia is also used as a structural component of the coating, and compared to other ceramics, is relatively soft. It has a relatively high thermal expansion coefficient ($10.5\times10^{-6}/°K$), which is close to that of the cast iron shell ($13\times10^{-6}/°K$), and is chemically compatible with the silicate solution. When the magnesia concentration falls below about 5%, cracking may occur as a result of thermal cycling. When the magnesia concentration exceeds about 30%, the coating strength will be reduced.

The aluminum oxide, calcium oxide, titania, and chromium oxide content comes from the kaolin and montmorillonite minerals which are colloidal-particle-type clay binders and flocculants. The colloidal particles are adsorbed and bridge between the ceramic particles. These minerals increase the green strength of the coating, improve the wetting of the ceramic particles, thicken the slurry, alter the rheology of the slurry (i.e., dependence of viscosity on temperature), and retard the settling out of the particles in the slurry.

The sodium silicate is used as a binder for the ceramic particles and a deflocculant or thinner for the slurry which affects its flow properties. The silicate solution contains silica which is suspended as colloidal particles 1–2 ηm in diameter. The reaction of the colloidal silica with the surfaces of the magnesia is believed to form magnesium silicate which bonds the particles together. Similarly Al2O3 present may react with the colloidal silica to form aluminum silicate at the interfaces upon firing of the coated manifold.

Bonding of the ceramic coating to the casting is readily achieved without any special treatment of the casting surface other than cleaning. In this regard, the arithmetic mean of the roughness of sand castings typically ranges from 3 microns to 30 microns with about 15 microns being commonplace. This is sufficiently rough that the coating adheres readily thereto without having to roughen or otherwise treat the surface. The surface will simply be cleaned by sandblasting which removes sand and carbon particles therefrom as well as any aberrant high points that may occur on the surface.

EXAMPLES

An exhaust manifold was sand cast from nodular iron and coated with three layers of ceramic in accordance with the present invention as follows. 1400 grams of a room temperature aqueous sodium silicate solution was prepared comprising 35% by weight sodium silicate having a silica-to-sodium oxide ratio of 3.3. The solution was continuously stirred in a Kitchenaid mixer and had the following ingredients added thereto: (1) 720 grams of silica, (2) 360 grams of magnesia, (3) 60 grams of kaolin and (4) 60 grams of montmorillonite to form a thick slurry having a viscosity of 60 poises. The casting had all but one of its openings sealed. The slurry was subjected to a vacuum of 1 Torr for 3 minutes and then poured into the casting so as to completely fill the same. The casting was then vibrated at a frequency of 10 Hertz and an amplitude of 4 mm for 2 minutes to insure that the slurry wetted the entire inside surface of the casting. The slurry was then dumped from the casting leaving a layer of slurry clinging to the inside surface. The manifold was kept at room temperature for 5 hours to dry the coating and provide a dense first layer 0.8 mm thick. The aforesaid process was repeated, but without subjecting the slurry to a vacuum, to form a second porous layer atop the first layer which is 1.0 mm thick and has a macroporosity of 12%. Finally, the process used to form the first layer is again used to deposit a third and last layer atop the second layer. The third layer was dense and had a thickness of 1.0 mm. After the coating was dried at room temperature, the manifold was then fired to cure the entire coating. More specifically, the manifold was (1) heated at a rate of 5° C./minute up to 85° C. and held for 1 hour, (2) then heated at 5° C./minute up to 120° C. and held for 2 hours, and (3) finally heated at 5° C./minute up to 250° C. and held for 2 hours followed by cooling at a rate of 20° C./minute to room temperature. Coatings so made demonstrated good hot corrosion resistance at a continuous working temperature of about 800° C. for 8 hours, a specific gravity of 2.5 g/cc, a compressive strength of 4000 psi, a coefficient of thermal expansion of $10.5\times10^{-6}/°K$, a thermal conductivity of 2.3 W/m/°K, and a specific heat of 390 J/kg/°K.

The coated manifolds were tested by placing them in an oven and heated externally at a rate of 50° C./minute to 60° C. Thereafter the manifolds were cooled (at 80° C./min.) to room temperature and inspected for cracking, delamination, crazing and separation from the casting, none of which was found after 20 cycles.

While the invention has been disclosed in terms of specific embodiments thereof it is not intended to be limited thereto but only to the extent set forth hereafter in the claims which follow.

What is claimed is:

1. In the method of an exhaust manifold for an internal combustion engine comprising the principle steps of casting iron shell conforming to the shape of said manifold and coating the inside surface of said shell with ceramic, the improvement comprising:

a. preparing a slurry comprising a mixture of ceramic and mineral particles suspended in an aqueous solution of sodium silicate, said mixture comprising by weight about 55% to about 65% silica about 25% to about 35% magnesia, about 2% to about 8% kaolin, and about 2% to about 8% montmorillonite, said solution comprising about 20% to about 40% by weight dissolved sodium silicate having a silica to sodium oxide molar ratio between about 2.5 and 3.8, and said slurry comprises by weight about 40 to 48 parts of said solution;

b. filling said shell with said slurry so as to thoroughly wet said inside surface with said slurry;

c. emptying said shell of said slurry so as to leave a layer of said slurry adhering to said surface;

d. drying slurry to form a substantially dehydrated layer on said surface;

e. repeating steps b–d above at least once to incrementally buildup said coating to a desired overall thickness via a plurality of layers of lesser thickness; and f. heating the coated manifold to completely dehydrate said sodium silicate and promote reactions between said particles and said sodium silicate at the interfaces therebetween and thereby bond said particles together.

2. A method according to claim 1 including the step of subjecting said slurry to a sufficient vacuum to degas said slurry prior to coating said shell therewith so as to form at least one of said layers a denser than another of said layers.

3. A method according to claim 2 wherein the slurry used to form the outermost layer of said coating is subjected to said vacuum to form a substantially dense said outermost layer, and the slurry used to form at least one underlayer of said coating is not subjected to such vacuum to form a porous said underlayer.

4. A method according to claim 3 wherein the slurry used to form a first layer contacting said inside surface is subjected to said vacuum to form a substantially dense said first layer for promoting good adhesion between said coating and said surface.

5. A method of coating an inside surface of a hollow substrate with ceramic, comprising the steps of:

a. preparing a slurry comprising a mixture of ceramic and mineral particles suspended in an aqueous solution of sodium silicate, said mixture comprising by weight about 55% to about 65% silica oxide, about 25% to about 35% magnesia, about 2% to about 8% kaolin, and about 2% to about 8% montmorillonite, said solution comprising about 20% to about 40% by weight dissolved sodium silicate having a silica to sodium oxide molar ratio between about 2.5 and 3.8, and said slurry comprises by weight about 40 to 48 parts of said solution;

b. introducing said slurry into said hollow substrate so as to thoroughly wet said inside surface with said slurry;

c. emptying said substrate of said slurry so as to leave a layer of said slurry adhering to said surface;

d. Drying said slurry to form a substantially dehydrated layer on said surface;

e. repeating steps b–d above at least once to incrementally buildup said coating to a desired overall thickness via a plurality of layers of lesser thickness than said overall thickness; and f. heating the coated substrate to completely dehydrate said sodium silicate and promote reactions between said particles and said sodium silicate at the interfaces therebetween and thereby bond said particles together.

6. A method according to claim 5 including the step of subjecting said slurry to a sufficient vacuum to degas said slurry prior to coating said substrate therewith so as to form at least one of said layers denser than another of said layers.

7. A method according to claim 6 wherein the slurry used to form the outermost layer of said coating is subjected to said vacuum to form a substantially dense said outermost layer, and the slurry used to form at least one underlayer of said coating is not subjected to such vacuum to form a porous said underlayer.

8. A method according to claim 7 wherein the slurry used to form a first layer contacting said inside surface is subjected to said vacuum to form a substantially dense said first layer for promoting good adhesion between said coating and said surface.

* * * * *